US009212858B2

(12) United States Patent
Wilson

(10) Patent No.: US 9,212,858 B2
(45) Date of Patent: Dec. 15, 2015

(54) NON-DETACHABLE MAGAZINE

(71) Applicant: Sig Sauer, Inc., Newington, NH (US)

(72) Inventor: John Wilson, East Waterboro, ME (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/163,937

(22) Filed: Jan. 24, 2014

(65) Prior Publication Data

US 2014/0223790 A1 Aug. 14, 2014

Related U.S. Application Data

(60) Provisional application No. 61/756,798, filed on Jan. 25, 2013.

(51) Int. Cl.
*F41A 17/38* (2006.01)
*F41A 9/65* (2006.01)

(52) U.S. Cl.
CPC .. *F41A 9/65* (2013.01); *F41A 17/38* (2013.01)

(58) Field of Classification Search
CPC ..... F41A 9/65; F41A 17/36; F41A 17/38; F41A 17/34
USPC ..... 42/11, 17, 21, 22, 24, 29, 33, 35, 37, 42/39, 6, 49.01, 49.02, 50, 70.02, 18; 89/197, 33.1
See application file for complete search history.

(56) References Cited

U.S. PATENT DOCUMENTS

| | | | | | |
|---|---|---|---|---|---|
| 2,642,688 | A * | 6/1953 | Johnson, Jr. | ..... | 42/50 |
| 3,390,476 | A * | 7/1968 | Vervier | ..... | 42/50 |
| 4,016,667 | A * | 4/1977 | Forbes | ..... | F41C 27/00 42/18 |
| 4,430,821 | A * | 2/1984 | Vincent | ..... | F41A 9/67 42/50 |
| 5,452,534 | A * | 9/1995 | Lambie | ..... | F41A 9/71 42/18 |
| 5,685,101 | A * | 11/1997 | Ferretti | ..... | F41A 9/65 42/18 |
| 5,806,224 | A * | 9/1998 | Hager | ..... | F41A 17/38 42/18 |
| 6,739,082 | B2 * | 5/2004 | Christensen | ..... | F41A 9/70 42/49.02 |
| 7,941,955 | B2 * | 5/2011 | Stone | ..... | F41A 9/25 42/50 |
| 8,756,845 | B2 * | 6/2014 | Harris | ..... | F41A 9/64 42/16 |
| 2013/0269232 | A1 | 10/2013 | Harris et al. | | |

* cited by examiner

*Primary Examiner* — Samir Abdosh
*Assistant Examiner* — John D Cooper
(74) *Attorney, Agent, or Firm* — Finch & Maloney PLLC

(57) ABSTRACT

A non-detachable magazine configured to be used for new manufacture of firearms or configured to replace a detachable magazine of an existing firearm is disclosed. The magazine may be pivotally mounted on a firearm using a hinge pin, allowing the feed end of the magazine to enter and retreat from the magazine well of the firearm. The magazine includes a magazine body and at least one arm connecting the magazine body to the hinge pin. In some embodiments, a firearm can be made compatible with the disclosed non-detachable magazine such that removal of the magazine is tantamount to disassembly of the firearm, and/or removal of the magazine renders the firearm inoperable.

18 Claims, 10 Drawing Sheets

NON-DETACHABLE MAGAZINE

RELATED APPLICATION

This application claims the benefit of U.S. Provisional Patent Application Ser. No. 61/756,798, titled "NON-DETACHABLE MAGAZINE" filed Jan. 25, 2013 and which is incorporated by reference in its entirety herein.

BACKGROUND

1. Field of the Disclosure

The present invention relates to a non-detachable magazine for a firearm, and specifically relates to a pivotable non-detachable magazine having at least one arm connectable or integral to a hinge pin.

2. Discussion of Related Art

A magazine is a device used to store and feed ammunition to a firearm. A magazine holds and releases ammunition into the chamber of a firearm. Magazines configured to be insertable and removable from a firearm are commonly referred to as 'detachable.' Other magazines are formed as an integral part of the firearm or are otherwise made non-detachable from the firearm.

SUMMARY

According to an example embodiment, a non-detachable magazine assembly for a firearm includes a magazine body having a feed end, a base end and an outer surface defining a right side, a left side, a front side and a back side. The magazine assembly further includes a hinge pin retained in a receiver of a firearm and at least one arm pivotally connecting the magazine body to the hinge pin. In some cases, the magazine assembly includes one arm permanently attached to the outer surface of the magazine body. In some cases, the magazine assembly is limited to a single pivot point and a single axis of travel. In some cases, the magazine assembly includes two arms attached to the magazine body.

According to another example embodiment, a non-detachable magazine assembly for a firearm includes a magazine body, a hinge pin configured to be retained in a transverse horizontal aperture of the firearm, and at least one arm pivotally connecting the magazine body to the hinge pin. The hinge pin is a pivot pin and attaches a lower receiver to an upper receiver. In some cases, wherein detaching the magazine from the firearm renders the firearm inoperable. In some cases, the magazine body holds a maximum of 10 rounds. In some cases, the magazine assembly is limited to a single pivot point and a single axis of travel.

According to another example embodiment, a firearm includes at least one receiver having a transverse horizontal aperture extending therethrough. The firearm also includes a magazine well and a non-detachable magazine assembly. The magazine assembly includes a hinge pin retained inside the aperture and a magazine body pivotally connected to the hinge pin. The magazine body has an angular path of travel limited to less than 120°. In some embodiments, the path of travel is limited to less than 100°, less than 90°, or less than 80°. In some embodiments, at least one arm connects the magazine body to the hinge pin. In some embodiments, two arms connect the magazine body to the hinge pin. In some embodiments, the hinge pin is integral to the magazine body. In some embodiments, one central arm connects the magazine body to the hinge pin. In some embodiments, the magazine body comprises a latch member and the magazine well comprises a mating latch member. In some embodiments, the receiver is a lower receiver and the firearm also includes an upper receiver and the hinge pin connects the upper receiver to the lower receiver of the firearm. In some embodiments, the magazine body must be refilled manually after firing a maximum of 11 shots. In some embodiments, the magazine assembly is limited to a single pivot point and a single axis of travel.

The features and advantages described herein are not all-inclusive and, in particular, many additional features and advantages will be apparent to one of ordinary skill in the art in view of the drawings, specification and claims. Moreover, it should be noted that the language used in the specification has been selected principally for readability and instructional purposes and not to limit the scope of the inventive subject matter.

BRIEF DESCRIPTION OF THE DRAWINGS

FIG. 5A depicts the magazine assembly in a closed position and FIG. 5B depicts the magazine assembly in an open position.

FIG. 6A shows the magazine assembly in a closed position and FIG. 6B shows the magazine assembly in an open position.

FIG. 10A shows the magazine assembly in a closed position and FIG. 10B shows the magazine assembly in an open position.

DETAILED DESCRIPTION

Figure 1:
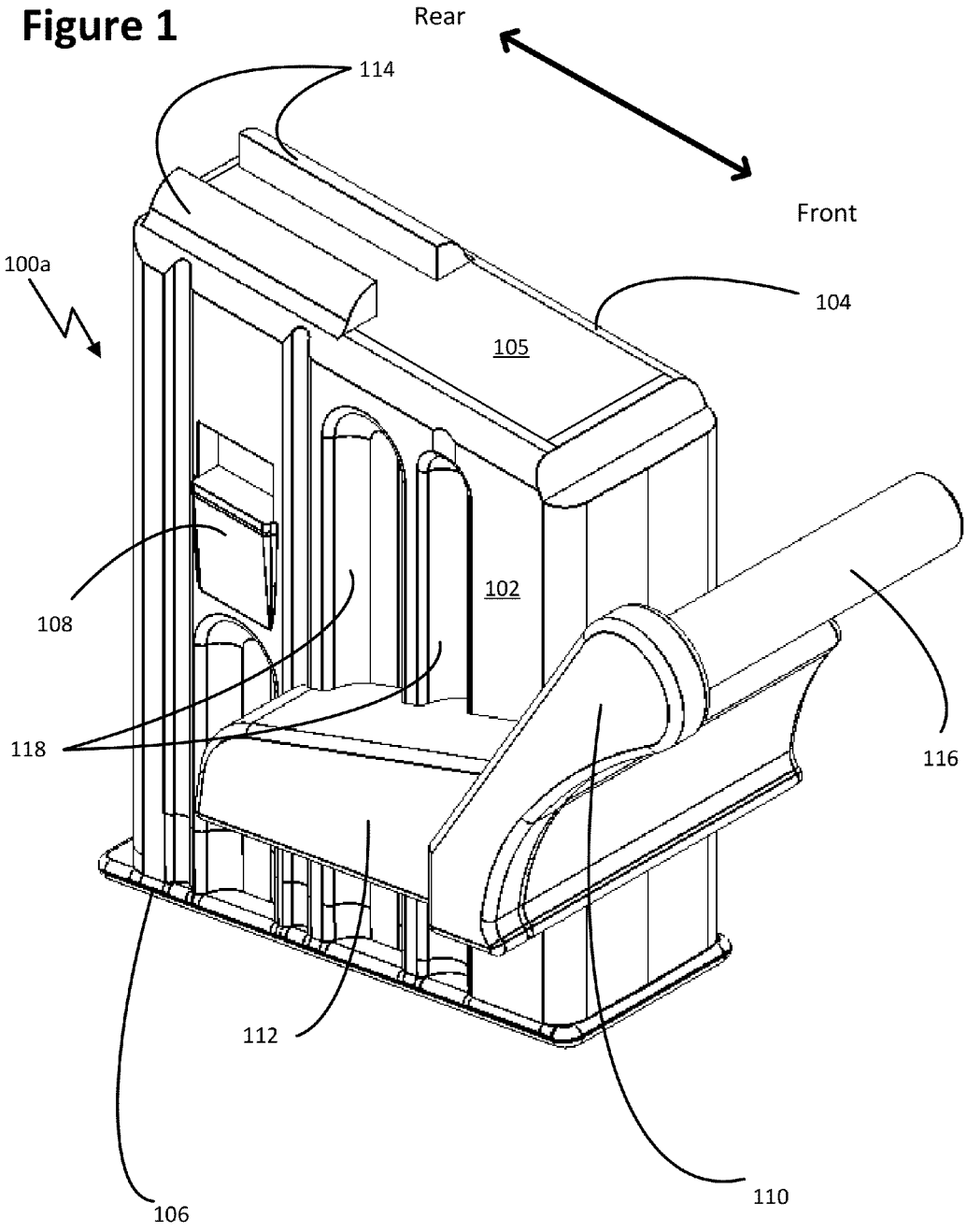
FIG. 1 is a right perspective view of a non-detachable magazine assembly according to one embodiment of the present disclosure.

Detachable magazines are configured to be retained in a firearm's magazine well and generally include a spring-loaded follower that feeds ammunition to the firearm. When ammunition is loaded into the magazine, the ammunition pushes the follower down, thereby compressing the spring. In use, when one round of ammunition is expended, the compressed spring releases and pushes the follower and associated ammunition upwards toward the firearm and the next round of ammunition is thereby readied.

The present disclosure relates to a non-detachable magazine assembly. The non-detachable magazine assembly can be used in the new manufacture of a firearm or can alternatively be utilized to replace a detachable magazine. Alterations can be made to an existing firearm compatible with detachable magazines to ensure that the firearm is no longer compatible with detachable magazines and may only be used with non-detachable magazines, such as those disclosed herein.

The disclosed non-detachable magazine assembly is configured to be pivotally attached to a firearm. In embodiments where the non-detachable magazine is coupled with a firearm having an upper receiver and a lower receiver that are pivotally connected by a hinge pin, the disclosed magazine may be mounted on the hinge pin and thereby attached to the firearm. In some such embodiments, removal of the magazine may result in disassembly and/or disabling of the firearm. In embodiments where the non-detachable magazine is coupled with a firearm having a single receiver or frame, or having receivers that are not pivotally connected, the disclosed magazine may be mounted, for example, to the firearm on the firearm's forward takedown pin.

General Overview

Magazines can be either fixed and integral to a firearm or detachable and therefore removable from a firearm. A fixed magazine is built into the firearm and generally not readily removable. In contrast, detachable magazines may freely be inserted and removed from a firearm. Detachable magazines allow a firearm to be quickly reloaded with a second magazine of ammunition after a first magazine of ammunition has been depleted. Thus, a firearm's compatibility with detachable magazines is associated with offensive capability.

Legislation at the Federal and State level has limited and may further limit the type of magazines able to be employed with various types of firearms. For example, the amount of ammunition (the capacity) held by a single magazine may be restricted. Similarly, the use of detachable magazines may be restricted or even prohibited in the future. A firearm's compatibility with detachable magazines may be considered indicative of an offensive capability, and alone or in combination with other such features may relegate the firearm to a restricted or illegal category.

While firearms may face increased regulation with respect to detachable magazines, users may be hesitant to abandon the familiar structure and appearance of a firearm compatible with detachable magazines. Additionally, manufactures have developed expertise in producing such firearms in a cost effective manner and may face challenges in manufacturing firearms having non-detachable magazines. Non-detachable magazines may thus pose non-trivial challenges for both consumers and manufacturers. What is disclosed herein is a non-detachable magazine assembly and methods of making and using the non-detachable magazine assembly. The disclosed magazines can be formed to restrict the quantity of ammunition that can be deployed before reloading. For example, a non-detachable magazine may preclude use of a detachable magazine and/or may restrict the output of a firearm by not supporting rapid replenishment subsequent to the stored ammunition being depleted. In this way a non-detachable magazine may reduce or eliminate the offensive capabilities of the firearm as evaluated under existing or proposed legislation.

When mounted on a firearm, the disclosed non-detachable magazine assembly can maintain a similar form and appearance as a firearm having a detachable magazine. The disclosed magazine assembly can thus be desirable for consumers due to familiarity, aesthetics and historical significance. Additionally, the disclosed magazine assembly capitalizes on accessible techniques and methods for creating and modifying firearms, making production of the non-detachable magazines feasible for manufacturers. The disclosed magazine assembly may thus allow a firearm to comply with the law by restricting offensive capability, offer a desirable and marketable firearm to consumers, and utilize current tooling and inventory to produce firearms outfitted with the disclosed magazine assembly.

In one aspect, a non-detachable magazine that replaces a detachable magazine while allowing for minimal structural or physical changes to the firearm and also allowing for a design that is usable, desirable and marketable is disclosed. The magazines disclosed herein may utilize existing inventory and retain the familiar firearm structure compatible with a detachable magazine while also complying with ammunition regulations.

The magazines disclosed herein may be interface with a wide variety of firearms. Specifically, the disclosed magazines may be suitable for use with many if not all automatic or semi-automatic rifle, such as an AR-15, an M4 carbine, an AR-10, an M16, or the SIGM400 Series tactical rifle as produced by SIG SAUER. Additionally, the disclosed magazines may be suitable for use with any handgun, such as a P210, P220, P226, P228, P230 and P250, as produced by SIG SAUER. For simplicity, the term "rifle" or "firearm" as used in this disclosure shall be understood to include all described and similar firearms.

The present disclosure is applicable to many if not all firearms, including firearms having a single receiver, alternatively referred to as a frame, or multiple receivers. For clarity, the term "receiver" as used in this disclosure means the receiver of a firearm having a single receiver, the frame of a handgun, or the receiver bearing the serial number of the firearm if the firearm includes multiple receivers, unless otherwise indicated. Similarly, the reference numeral 200 shall be understood to refer to both a firearm in general and more specifically, to a firearm receiver.

The terms "rear" and "rearward" as used herein mean in the direction away from the muzzle of the firearm. The terms "front" and "forward" are used to indicate a direction towards the muzzle of the firearm. As used herein, the terms "left" and "right" correspond to the left and right direction of a user while holding the firearm in a typical position.

The terms "longitudinal," "transverse," "horizontal," and "vertical" are used herein to indicate directions relative to a firearm barrel when held by a user and pointed in a horizontal direction. "Longitudinal" thus means along or parallel to the axis of the barrel and "transverse" means in a horizontal direction perpendicular to longitudinal.

Structure and Operation

The disclosed magazine assembly generally includes a magazine body and at least one arm. The arm may be connectable to a hinge pin or may include a hinge pin as an integral component. The hinge pin may be secured in the receiver of the firearm, thereby allowing the disclosed magazine assembly to be pivotally mounted on a firearm. In some embodiments, the magazine may be non-detachable from the firearm. The term "non-detachable" means that the magazine cannot be detached from the firearm without significant effort by the user, unlike easily swappable conventional magazines. For example, in some cases, a non-detachable magazine may require more than 10 seconds to be removed from a firearm. In another embodiment, a non-detachable magazine may require specific tools in order to detach the magazine from a firearm. In other embodiments, detaching the magazine will damage or destroy at least a portion of the firearm and/or result in at least partial disassembly of the firearm. In other embodiments, detaching the magazine will render the firearm inoperable or impractical to use.

When mounted on the firearm via a hinge pin, the magazine body may pivot between an open and closed position with respect to the magazine well of the firearm. The disclosed magazine assembly may be attached to a firearm by a single pivot point and proceed in a single axis of travel. In an open position, the feed end of the magazine may be accessible to a user, allowing ammunition to be unloaded or loaded into the magazine. The magazine body may pivot suspended from the hinge pin such that the feed end enters the magazine well of the firearm. The magazine body may adopt a closed position, wherein the magazine body is at least partially inserted into the magazine well. The magazine body may also adopt a locked position, wherein the magazine is latched or otherwise retained in a stationary position with respect to the firearm. For example, the magazine body may include a latch member on the magazine body and the firearm receiver may include a mating latch member to the latch on the magazine. The mating latch member may be controllable by a release lever located on the receiver, which may release the magazine body from the magazine well to an open position. In some embodiments, the latch member on the magazine body is an aperture or a tab that is engaged by the mating latch member in the firearm receiver.

General Description of the Magazine

In some embodiments, the disclosed magazine assembly may be configured to store up to a fixed number of ammunition rounds. This fixed number can be referred to as the capacity of the magazine. The capacity of the magazine may be any desired number, including 35, 30, 20, 15, 12, 10, or 8 rounds of ammunition. In this way, a user may be able to fire a limited number of rounds of ammunition, specifically, the number of rounds the magazine may accommodate, before manually reloading the non-detachable magazine.

Certain rifles may require additional modification to the magazine well area in order to enable the magazine to pivot into the well of the firearm. The additional modifications may require shaping or cutting of the receiver to create the metal reductions necessary to accommodate pivoting magazine assembly 100. Likewise, some magazine designs may require further modification of the firearm to accommodate the magazine body being pivoted into the magazine well. In some embodiments, the receiver may be modified by removing at least a portion of the receiver to allow the magazine body to freely pivot from the hinge pin. For example, the depth of the receiver underneath the hinge pin may be reduced to be less than half the depth of the receiver at a point proximal to the rear of the receiver. The receiver of the firearm may also be formed or modified to include a slot in the forward wall of the magazine well to allow at least one arm 100 to extend from the magazine body to the hinge pin, and to allow the magazine body to rotate into and out of the magazine well. In other embodiments, the hinge pin may include an outer tubular piece which fits with the bearing diameters of the aperture and/or an inner axle which pivots within the outer piece, and to which an arm may be attached.

As a result of modification, the firearm may be made incompatible with detachable magazines. For example, the latch on the firearm receiver may be altered or changed such that the modified or new latch would only be capable of accepting and securing the non-detachable magazine. For example, the previous latching mechanism may be destroyed or disabled, leaving only the latching mechanism that is compatible with the non-detachable magazine operable. In other embodiments that utilize shelves inside the magazine well to retain the magazine, the shelves may be removed or otherwise altered to no longer retain a detachable magazine. In some such embodiments, the only retaining mechanism remaining may be the latching or other retaining mechanism employed to secure the non-detachable magazine disclosed herein.

In some embodiments the aperture in the firearm receiver into which the hinge pin may be inserted is transverse to the firearm. The aperture may be located where the forward takedown pin is insertable, and/or where the pivot pin is insertable. In some embodiments, the aperture may be created where no such hole previously existed. In embodiments wherein the magazine assembly includes an integral pivot pin, which may also function as the forward receiver pin, removal of the magazine from the firearm may be tantamount to disassembling the rifle. For example, in some such embodiments, once the magazine assembly is mounted on the firearm, to remove the magazine assembly, the rear pin of the firearm must first be removed. Thereafter, the upper and lower receiver must be pivoted with respect to each other on the axis of the pivot pin. The pivot pin may be removed, thus separating the upper from the lower receiver.

In some embodiments wherein the upper receiver and the lower receiver are pivotally connected by a pivot pin, the hinge pin of the magazine assembly may be configured to function as the pivot pin. In some such embodiments, the upper and/or lower receivers may include grooves that align when the receivers are rotated with respect to one another. For example, in an assembled position, the upper receiver and the lower receiver may interface to define a zero degree angle. The upper and lower receiver may pivot with respect to each other to form a 30° angle, a 45° angle, a 90° angle, or any other angle less than 180 degrees. The angle at which the grooves of the receivers align can be defined as the open angle. The hinge pin may include a blade or a tab that is formed to fit inside the aligned grooves of the upper receiver and lower receiver as the hinge pin slides into place between the receivers. The hinge pin may be inserted to its position while the receivers are positioned at the open angle. Once the hinge pin is inserted, the upper receiver and the lower receiver may be pivoted with respect to each other into an assembled position, defined by the receivers forming a zero degree angle. In this manner, the hinge pin may be retained inside the firearm while the receivers are assembled. The hinge pin may be removed by pivoting the receivers to the open angle. In such embodiments, removal of the hinge pin may result in disassembly of the firearm.

In embodiments wherein the magazine assembly 100 is attached to the pivot pin by screws or other fasteners which require tools to remove, removal of the magazine may render the firearm impractical, in that the firearm has been configured to be incompatible with other commercially-available magazines. For example, the design of the firearm may be modified such that the firearm does not accommodate detachable magazines. Likewise, the size, shape or placement of the aperture for the forward receiver pins may be changed in the design of the rifle to preclude use of pre-existing forward receiver pins and instead permit only a hinge pin as herein disclosed.

In some embodiments, the magazine can only be removed when the firearm is in a disassembled state. When the non-detachable magazine is installed on a firearm, the firearm may no longer be able to accept a detachable magazine. For example, a pivotally connected magazine can be constructed so that it reaches a stop (e.g., on the handguard) when pivoted forward (in an open position). When in contact with the forward stop, the pivoting magazine interferes with the path to the receiver so that a detachable magazine could not be inserted into the receiver. The open non-detachable magazine can thus spatially interfere with a detachable magazine. In some embodiments, the detachable magazine may open when compared to a closed position, to less than 120°, less than 100°, less than 90°, or less than 80° before hitting a forward stop. The firearm may also be configured to only be able to accept a fixed magazine, even when the firearm is in a disassembled state.

The magazine body of the magazine assembly may be made of materials having suitable strength and durability to resist heat from the firearm, such as titanium, ceramics, laminates, amorphous metals, etc. The magazine body, arm and/or shroud may be formed of sheet metal, polymer, composite or other suitable material. The hinge pin may be formed of steel, carbon fiber other suitable materials. In some embodiments, the magazine body, arm and/or shroud are formed from a polymer. Appropriate polymers are known to those of skill in the art and include polyolefins, polycarbonate, ABS, and fiberglass reinforced plastics. In some embodiments, the magazine body, shroud and arm are a single design element and may be made using a plastic molding process such as injection molding.

In some embodiments, the shroud may be designed to complement the structure of the receiver of the firearm. For example, a shroud may be formed to visually replace a portion of the receiver not present in the non-detachable embodiment. The firearm's dimensions may remain relatively consistent between a firearm that is compatible with a detachable magazine compared to the same firearm configured to accommodate the disclosed magazine assembly. In some embodiments, in the closed position, a firearm outfitted with the magazine assembly 100 may have the same appearance to a user as a firearm compatible with a detachable magazine.

A method of retaining a magazine on a firearm is also disclosed here. The method may comprise the acts of: inserting a hinge pin into a transverse aperture in a firearm receiver; securing at least one arm attached to a magazine body on the hinge pin such that the magazine body may pivot with respect to the firearm; loading ammunition into the magazine body; pivoting the magazine body into the magazine well of the firearm; and securing the magazine body inside the magazine well of the firearm.

The disclosed magazines may be formed in a variety of ways. The present disclosure discusses three particular embodiments of the magazine assembly 100 in detail: magazine assembly 100*a*, 100*b* and 100*c*. Magazine assembly 100*a* is an embodiment that includes one arm positioned on the side of the magazine body. Magazine assembly 100*b* is an embodiment that includes two arms positioned on opposite sides of the magazine body. Magazine assembly 100*c* is an embodiment that includes a center arm. It should be understood that any reference to magazine assembly 100 can be applied to any of magazine assemblies 100*a*, 100*b* and/or 100*c*.

Magazine Assembly 100*a*

FIG. 1 is a right side perspective view of an example magazine assembly 100*a* in accordance with an embodiment of the present disclosure. The example magazine assembly 100*a* shown in FIG. 1 includes an arm 110 positioned on a side of the magazine, connecting the magazine body 102 to the hinge pin 116. In some embodiments, the hinge pin 116 is integral to the arm 110; however, in other embodiments, the hinge pin 116 may be detachable from the arm 110. As used herein, the term "integral" means that the components are formed from a common piece, or the components are formed separately and are permanently attached, such as by welding, gluing, or with other suitable connectors known in the art. Hinge pin 116 may include one or more fasteners to prevent removal from the firearm.

Figure 2A:
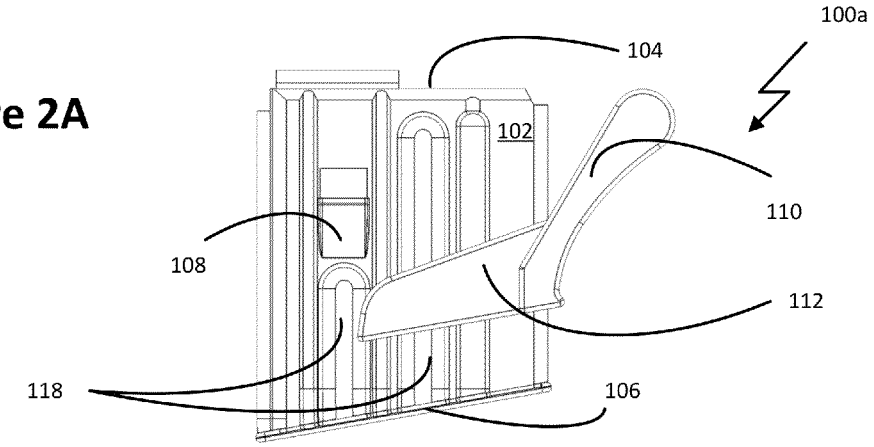
FIGS. 2A, 2B and 2C are a right side view, a left side view and a top view, respectively, of the magazine assembly shown in FIG. 1.
Figure 2B:
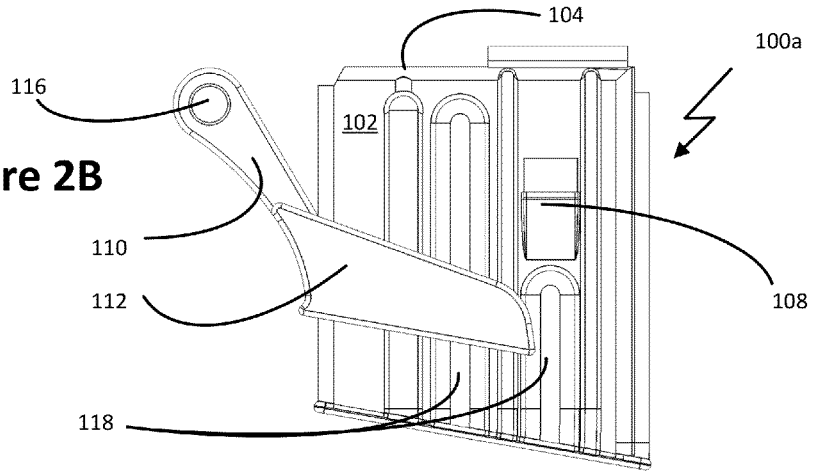
Figure 2C:
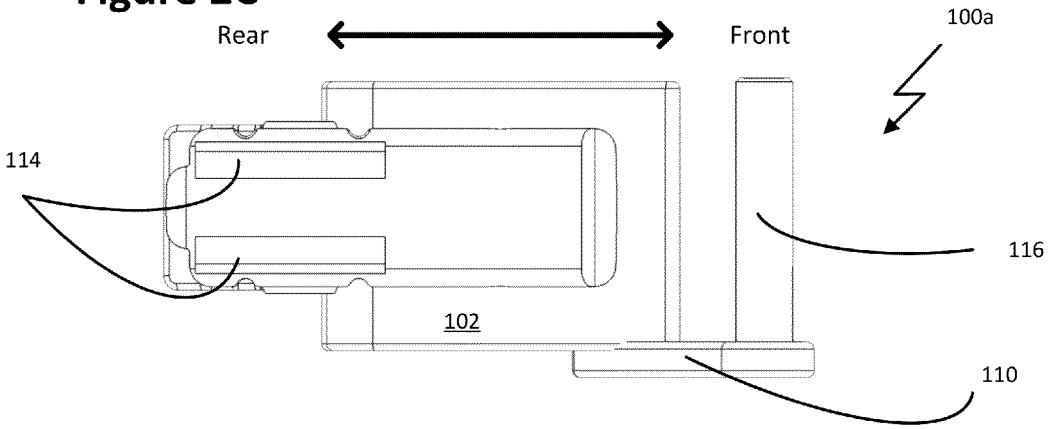

FIG. 2A shows a right side view of the magazine assembly 100*a* shown in FIG. 1, FIG. 2B shows a left side view of the magazine assembly 100*a* and FIG. 2C shows a top view of the magazine assembly 100*a*. As illustrated, the magazine assembly 100*a* may include a shroud 112, fixed to an outer surface of the magazine body 102. As shown, the magazine body 102 also includes open feed end 104 and closed base end 106. The feed end 104 includes an opening 105. The feed end 104 is formed to interface with the receiver of a firearm. In use, the feed end 104 enters the magazine well of a firearm, and the base end 106 remains outside the magazine well. The feed end 104 may include feed lips 114 to guide ammunition rounds to the firearm. The magazine body may also include at least one latch 108. The latch 108 may be an aperture formed in a wall of the magazine body 102 and/or a tab extending out from the magazine body 102. The latch 108 may communicate with the inside of the firearm's magazine well, allowing the magazine assembly to be retained inside the magazine well until it is released. As can be seen from FIGS. 2A and 2B, more than one latch 108 may be positioned on the magazine body 102. In some embodiments, a latch 108 may be positioned on the left side of the magazine, the front side and/or the rear side of the magazine body 102.

The magazine body 102 can be shaped in a variety of ways. For example, the magazine body 102 may be shaped as a box, holding ammunition rounds either in a standard (one-over-one) configuration or in a staggered or zigzag (double stacked or double column) configuration. The magazine body 102 may be straight or curved depending on the type of ammunition employed by the magazine and firearm. As shown, the magazine body can include grooves 118. The grooves 118 may enhance the rigidity of the magazine body 102 and/or may serve as internal guides for ammunition stored in the interior of the magazine body. The size and style of the magazine body 102 may be adjusted to allow for different ammunition capacity based on the size and design of the ammunition used.

Figure 3A:
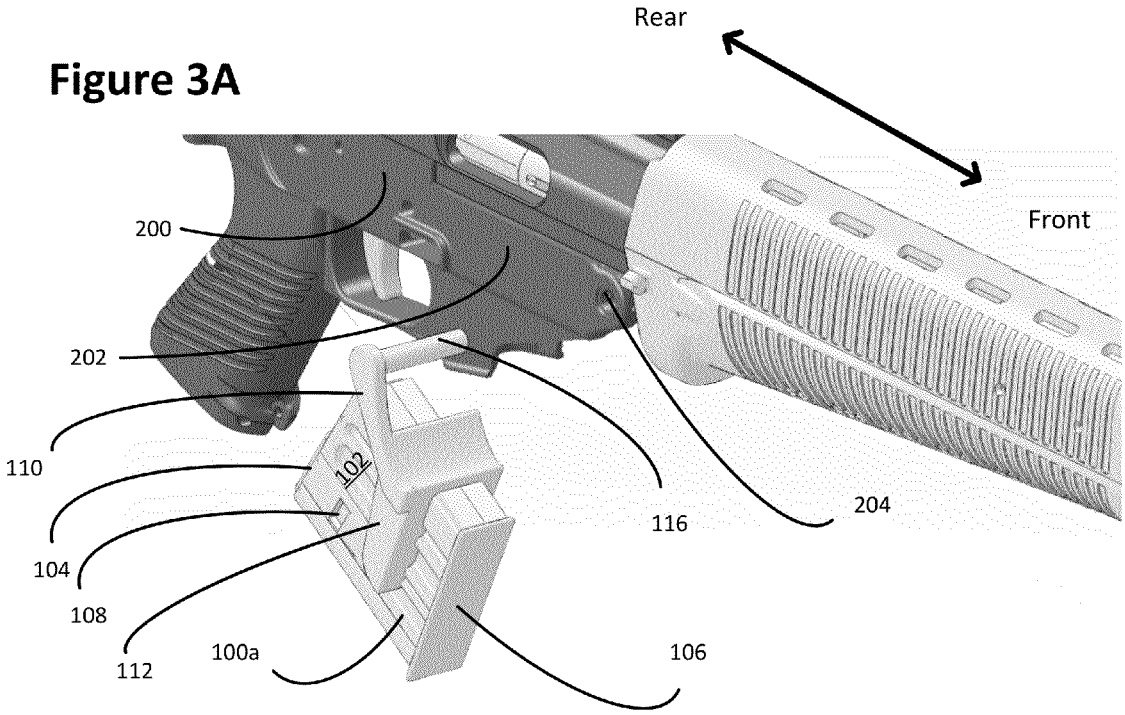
FIG. 3A is an exploded view of the magazine assembly shown in FIG. 1 mounted on a firearm in an open position.

FIG. 3A shows an exploded view of the magazine assembly 100*a* mounted on a firearm 200. As shown, the hinge pin 116 of magazine assembly 100*a* is configured to be inserted on the right side of the firearm 200 into the aperture 204. However, the arm 110 may be formed on the left side of the magazine body 102, rather than the right side, allowing the magazine assembly 100*a* to be inserted into the left side of firearm 200.

Figure 3B:
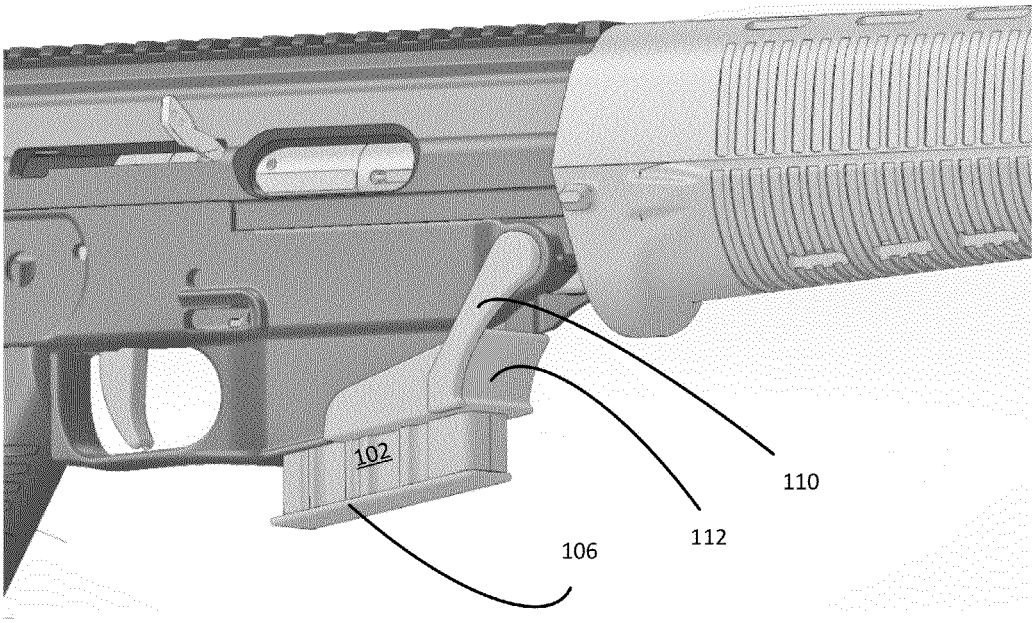
FIG. 3B is a right side view of the magazine assembly shown in FIG. 1 mounted on a firearm in a closed position.

FIG. 3B illustrates the magazine assembly 100*a* mounted on a firearm 200 in a closed position. The closed position may be defined by the magazine body 102 being at least partially inserted into the magazine well of the firearm 200. The latch 108 on the magazine body 102 may communicate with the magazine well and may retain the magazine body 102 in a locked position inside the firearm. A locked position may be defined by the magazine body being retained inside the magazine well in a fixed position relative to the firearm. The latch 108 may also be released, for example, by a release lever positioned on the outside surface of the firearm. Releasing the latch 108 may permit the magazine body 102 to be released from the locked position and pivot to an open position.

In some embodiments, the magazine assembly 100*a* may be mounted on a firearm in the following manner. In embodiments where the magazine assembly 100*a* comprises an integral hinge pin, the magazine assembly 100*a* may be mounted on a firearm by simply inserting the hinge pin 116 into an aperture 204 in the receiver of the firearm 200. In embodiments wherein the hinge pin 116 is not integral to the arm 110 or the magazine body 102, the magazine assembly 100*a* may be mounted on a firearm 200 by inserting the hinge pin 116 into an aperture 204 in the receiver of the firearm 200 and securing the arm 110 to the hinge pin 116. The hinge pin 116 may be inserted through the aperture 204 from the opposite side of the receiver. The arm 110 may be secured to the hinge pin 116 using screws, bolts or other connectors known in the art. The magazine assembly 100*a* may be removed from the firearm 200 by detaching the arm 110 from the hinge pin 116 and removing the hinge pin 116 from the aperture 204 in the receiver of the firearm.

Magazine Assembly 100*b*

Figure 4:
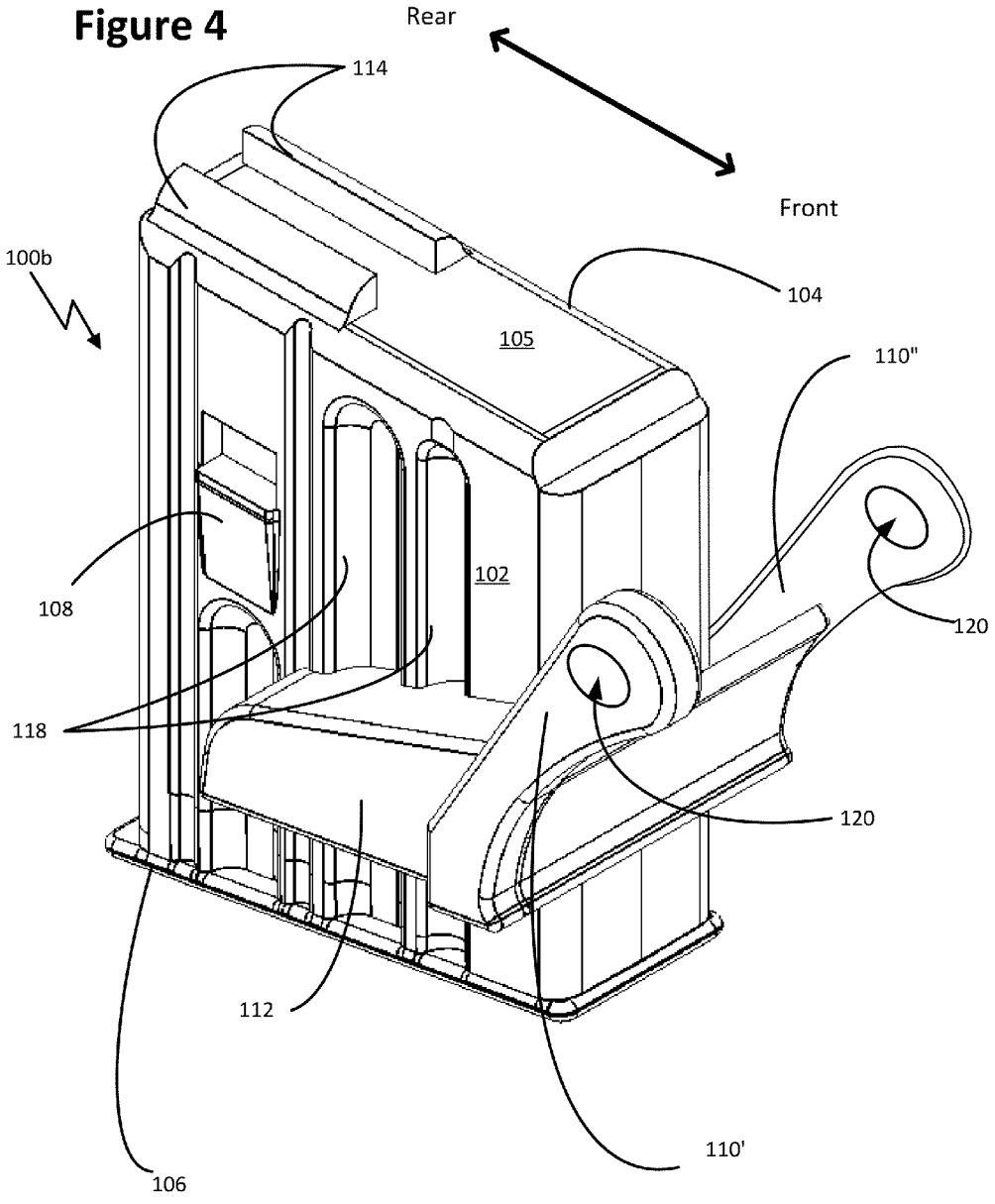
FIG. 4 is a right side perspective view of a non-detachable magazine assembly according to one embodiment of the present disclosure.

Another example embodiment of a magazine assembly is illustrated in FIG. 4. The magazine assembly 100*b* may include substantially similar or identical features as magazine assembly 100*a*. For example, magazine assembly 100*b* may include a feed end 104 with an opening 105, a base end 106, a shroud 112, a latch 108, grooves 118 and feed lips 114, as previously described. However, magazine assembly 100*b* need not include a hinge pin 116 that is integral to the magazine body 102. Additionally, the magazine assembly 100*b* includes two arms 110' and 110" on opposite sides of the magazine body 102, as shown in FIG. 4. One or both arms 110', 110" may include an opening 120 through which a connector may pass to secure the magazine body 102 to the hinge pin 116.

Figure 5A:
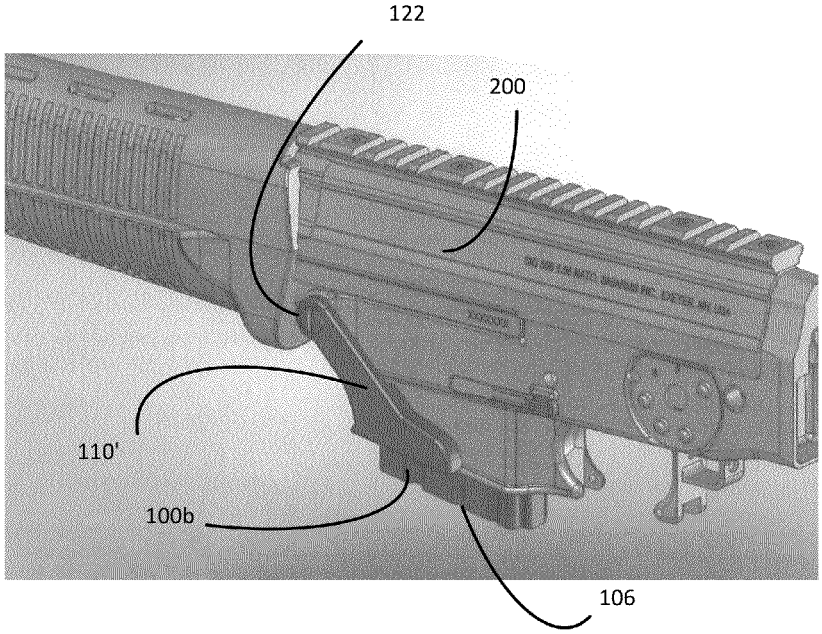
FIGS. 5A and 5B are left perspective views of the magazine assembly shown in FIG. 4 mounted on a firearm.
Figure 5B:
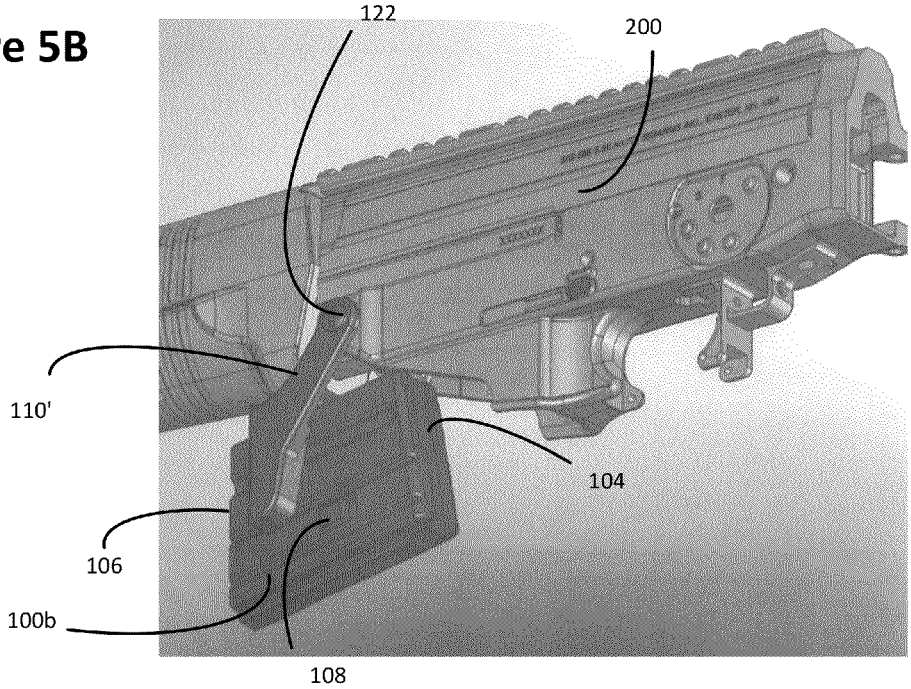

FIGS. 5A and 5B illustrate the magazine assembly 100*b* mounted on a firearm. FIG. 5A shows the magazine assembly 100*b* in a closed position and FIG. 5B shows the magazine assembly in an open position. When mounted on a firearm 200, the first arm 110' may be attached to a first end of the hinge pin and the second arm 110" may be attached to a second end of the hinge pin. The arms 110' and 110" may be attached to the hinge pin 116 by screws or any other type of connector 122. The hinge pin 116 may also be permanently attached, for example, by welding. The arms 110', 110" may be attached with a connector 122, such as a coaxial screw. Hinge pin 116 may include one or more fasteners to prevent removal from the firearm. The fasteners may be permanent or very difficult to remove, e.g., one way bolts or screws, or proprietary designs requiring specialized tools.

Figure 6A:
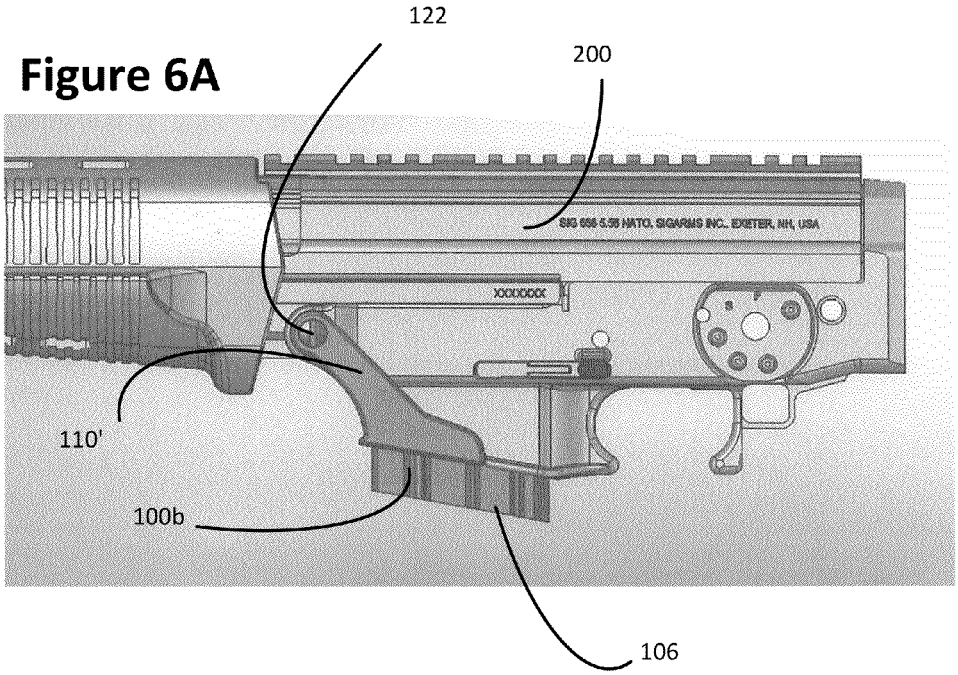
FIGS. 6A and 6B are left side views of the magazine assembly shown in FIG. 4 mounted on a firearm.
Figure 6B:
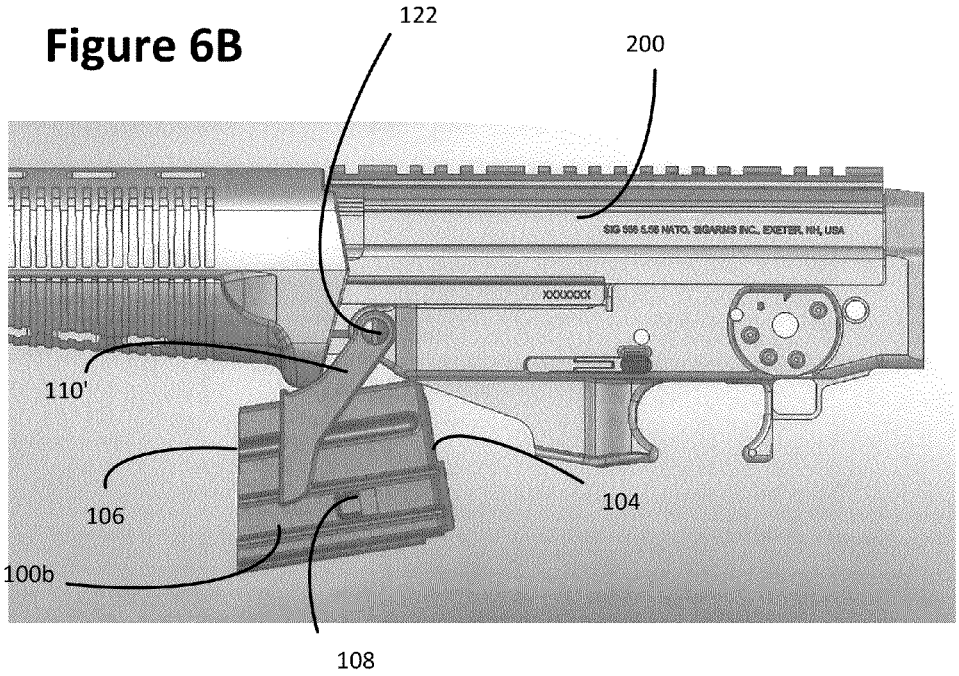

FIGS. 6A and 6B show left side views of the magazine assembly 100*b* mounted on a firearm 200. FIG. 6A shows the magazine assembly 100*b* in a closed position and FIG. 6B shows the magazine assembly 100*b* in an open position.

In some embodiments, the magazine assembly 100*b* may be mounted on a firearm 200 in the following manner. A hinge pin 116 may be inserted into an aperture 204 in the firearm. Either end of the hinge pin 116 may be inserted into the aperture first, or both ends can be inserted simultaneously. The arms 110' and 110" may be fastened to opposing ends of the hinge pin 116 to mount the magazine assembly 100*b* to the firearm 200.

In some embodiments, the magazine may be removed from a mounted position on the firearm by detaching arms 110' and 110" from the hinge pin 116, thus separating and the magazine body 102 from the firearm 200. In such an embodiment, the hinge pin 116 may remain retained within the aperture 204, rending the firearm assembled, but without a magazine.

Magazine Assembly 100*c*

Figure 7:
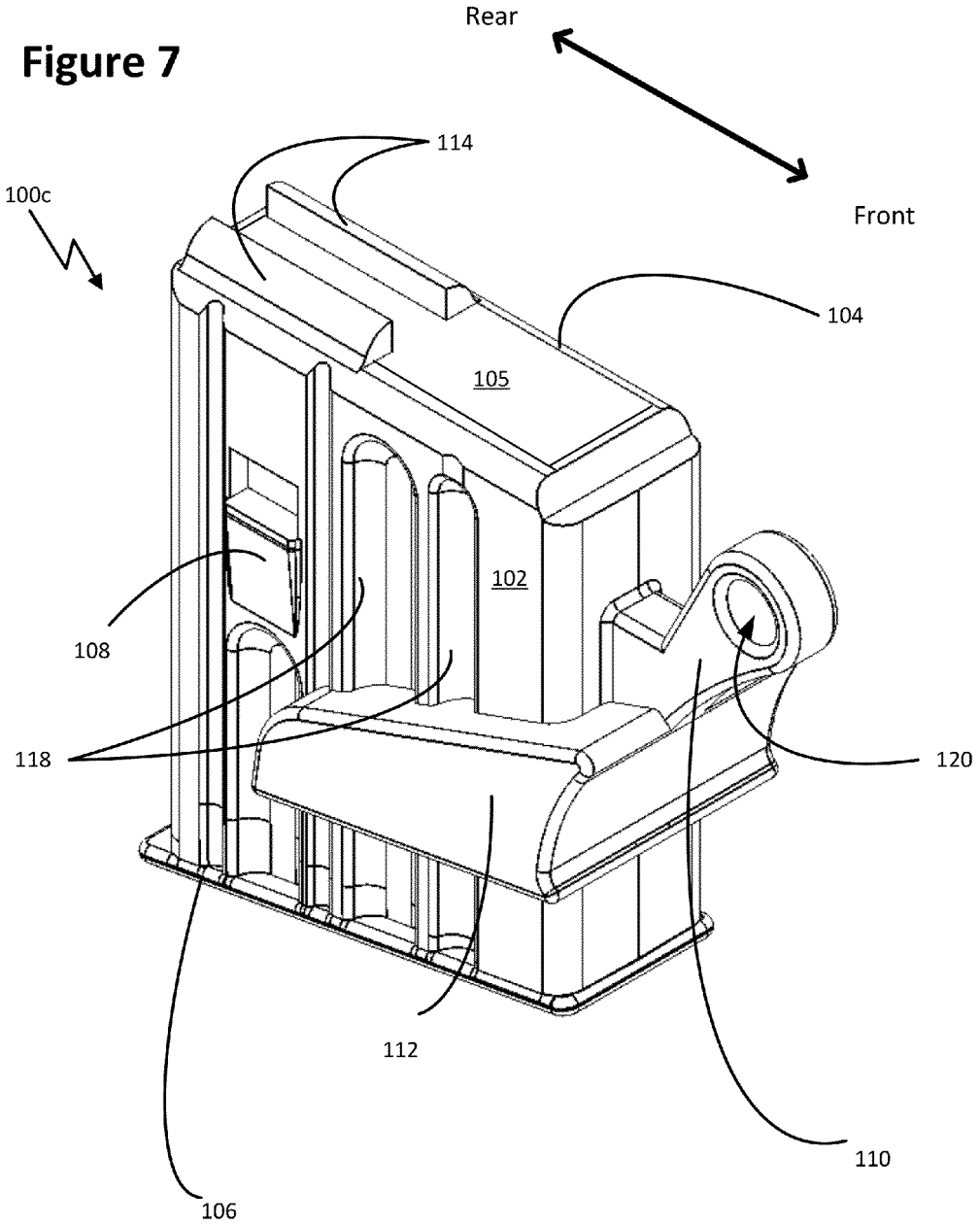
FIG. 7 is a right perspective view of a non-detachable magazine assembly according to one embodiment of the present disclosure.
Figure 8A:
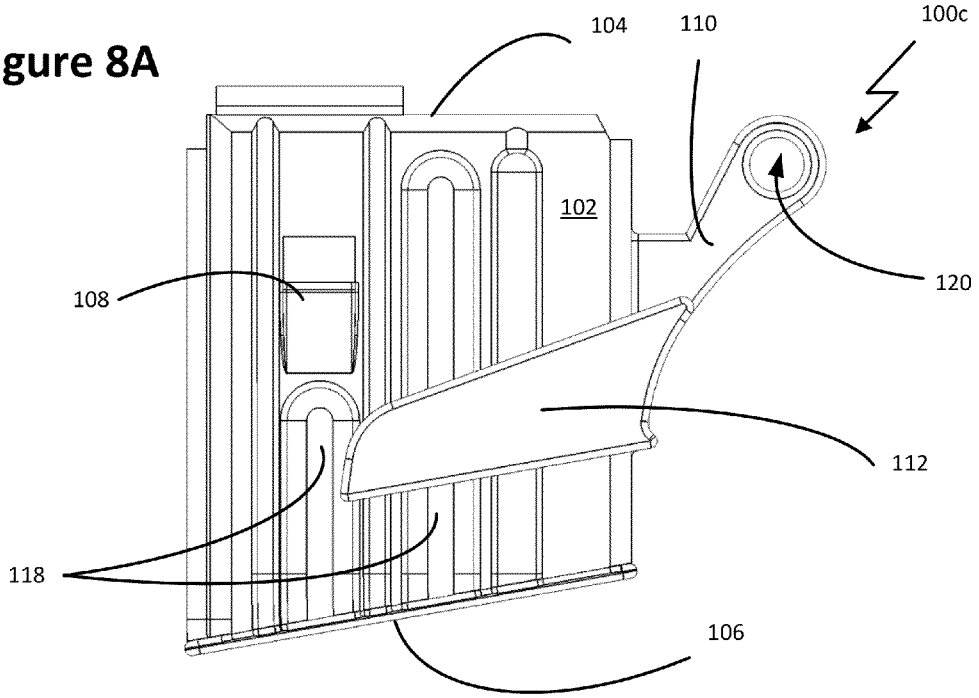
FIGS. 8A and 8B are a right side view and a top view, respectively, of the magazine assembly shown in FIG. 7.
Figure 8B:
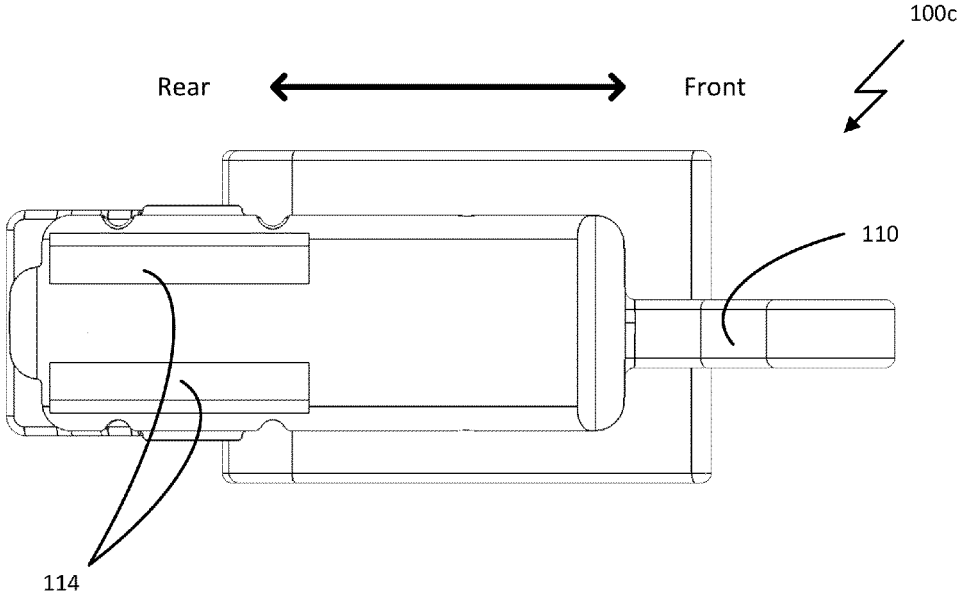

Another example embodiment of a magazine assembly 100*c* is shown in FIG. 7. The magazine assembly 100*c* includes an arm 110 positioned between the right and left sides of the magazine body 102. The arm 110 may extend from the magazine body 102 and may include an opening 120 at an upper end of the arm 110. The opening 120 may accommodate a hinge pin 116 (not shown). The other features of the magazine assembly 100*c* as shown in the provided figures are as described with respect to the magazine assemblies 100*a* and/or 100*b*. FIGS. 8A and 8B show a right side view and a top view of the magazine assembly 100*c*. The magazine assembly 100*c* may include the same features as discussed with respect to magazine assemblies 100*a* and 100*b*. In some embodiments, a hinge pin 116 is not integral to the arm 110. In some embodiments, the arm 110 includes an opening 120.

Figure 9:
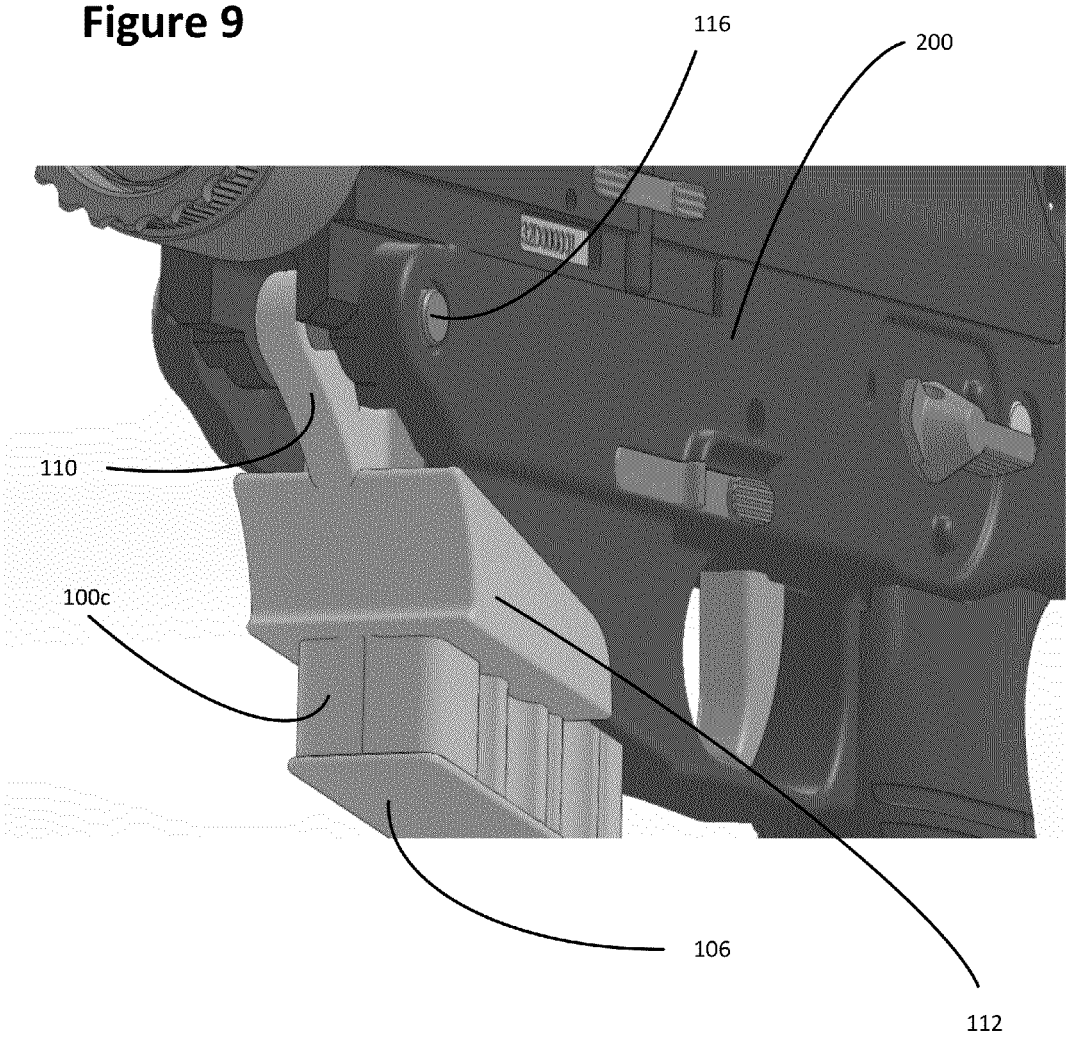
FIG. 9 is front left perspective view of the magazine assembly shown in FIG. 7 mounted on a firearm in a closed position.

FIG. 9 illustrates the magazine assembly 100*c* mounted on a firearm 200 in a closed position. The magazine assembly 100*c* may be coupled to a firearm by aligning the magazine assembly 100*c* such that the opening 120 is positioned to receive a hinge pin 116 that connects the magazine assembly 100*c* to the firearm 200. Specifically, the hinge pin 116 may connect the magazine assembly 100*c* to the receiver of the firearm, as shown in FIG. 9. In some embodiments, the hinge pin 116 is not integral to the arm 110 and/or the magazine body 102.

Figure 10A:
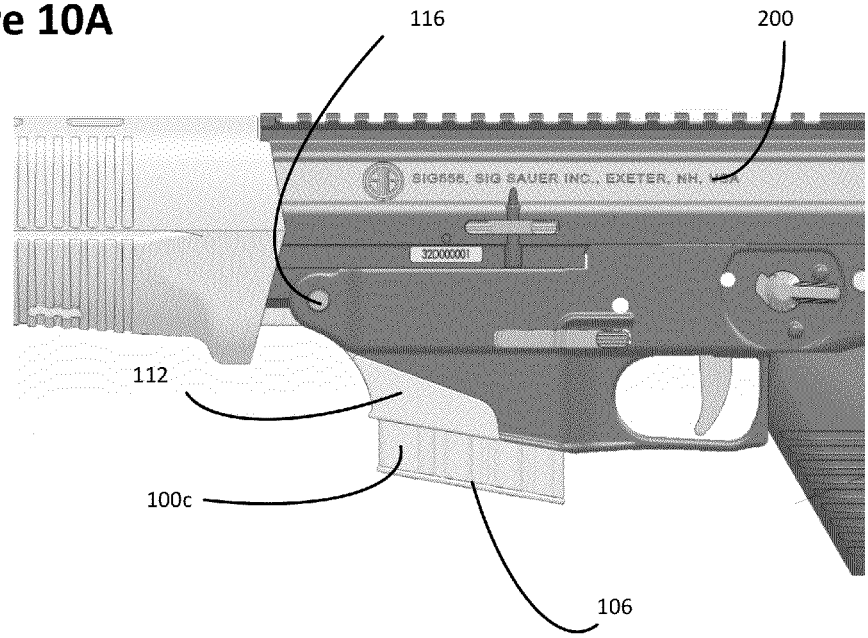
FIGS. 10A and 10B are left side views of the magazine assembly shown in FIG. 7 mounted on a firearm.
Figure 10B:
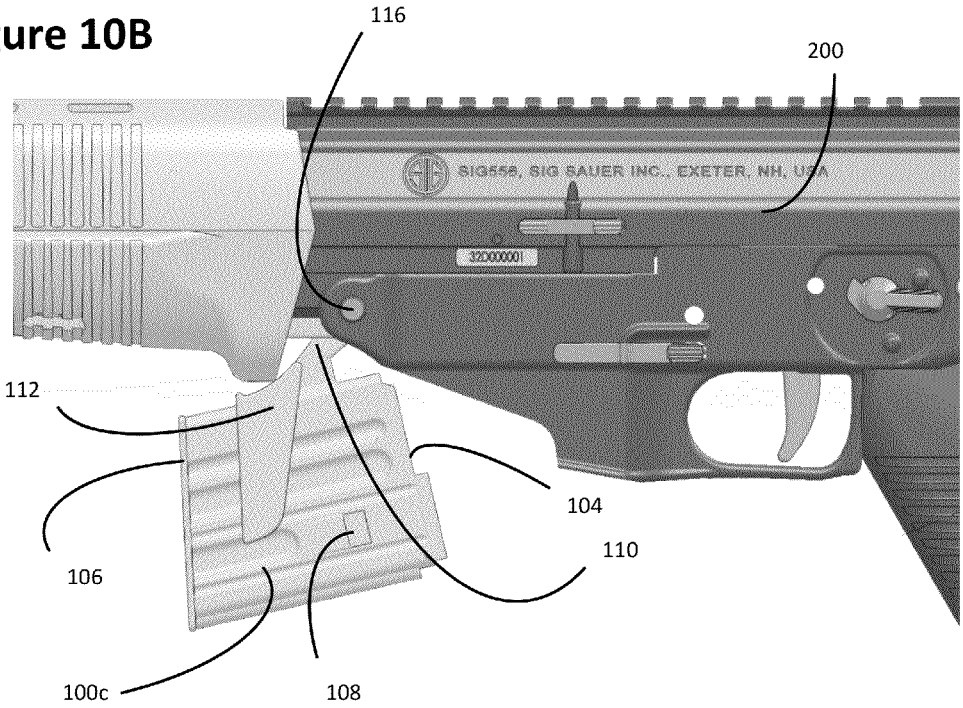

FIGS. 10A and 10B are left side view of the magazine assembly 100*c* mounted on a firearm 200. FIG. 10A depicts the magazine body 102 in a closed position and FIG. 10B depicts the magazine body in an open position. The magazine assembly 100*c* may be mounted on a firearm by, for example, placing the magazine body 102 into an open position with respect to the firearm 200, ensuring that the opening on the arm is in line with the aperture in the receiver. A hinge pin 116 may then be inserted from one side of the firearm through the opening in the receiver and the opening in the magazine arm to the other opening in the receiver. Screws or other fasteners may be utilized to secure the magazine body on the hinge pin 116. In this way, the magazine body 102 may be pivotally mounted on the firearm 200.

To disconnect the magazine assembly 100*c* from the firearm 200, the hinge pin 116 may be removed, at least partially, from the aperture 204 in the firearm 200 to release the arm 110 from the firearm 200. In this way, removal of the magazine assembly 100*c* may result in disassembly of the firearm 200 to the extent that the hinge pin 116 must be removed, at least in part, to detach the magazine assembly 100*c* from the firearm.

What is claimed is:

1. A non-detachable magazine assembly for a firearm having a lower receiver and an upper receiver, the magazine assembly comprising:

a magazine body having a feed end, a base end and an outer surface defining a right side, a left side, a front side and a back side;

a hinge pin retained in a receiver of a firearm; and at least one arm pivotally connecting the magazine body to the hinge pin, wherein the hinge pin attaches the lower receiver to the upper receiver.

2. The non-detachable magazine assembly of claim 1 wherein the magazine assembly includes one arm permanently attached to the outer surface of the magazine body.

3. The non-detachable magazine assembly of claim 1 wherein the magazine assembly is limited to a single pivot point and a single axis of travel.

4. The non-detachable magazine assembly of claim 1 wherein the assembly includes two arms attached to the magazine body.

5. The non-detachable magazine assembly of claim 1 wherein detaching the magazine from the firearm renders the firearm inoperable.

6. The non-detachable magazine assembly of claim 1 wherein the magazine body holds a maximum of 10 rounds.

7. The non-detachable magazine assembly of claim 1 wherein the magazine assembly is limited to a single pivot point and a single axis of travel.

8. A firearm comprising:

at least one receiver having a transverse horizontal aperture extending therethrough, wherein the receiver is a lower receiver and the firearm further comprises an upper receiver;

a magazine well; and a non-detachable magazine assembly comprising:

a hinge pin retained inside the aperture, the hinge pin connecting the upper receiver to the lower receiver; and a magazine body pivotally connected to the hinge pin, the magazine body having an angular path of travel, the path of travel limited to less than 120°.

9. The firearm of claim 8 wherein the path of travel is limited to less than 100°.

10. The firearm of claim 8 wherein the path of travel is limited to less than 90°.

11. The firearm of claim 8 wherein the path of travel is limited to less than 80°.

12. The firearm of claim 8 wherein at least one arm connects the magazine body to the hinge pin.

13. The firearm of claim 8 wherein two arms connect the magazine body to the hinge pin.

14. The firearm of claim 8 wherein the hinge pin is integral to the magazine body.

15. The firearm of claim 8 wherein one central arm connects the magazine body to the hinge pin.

16. The firearm of claim 8 wherein the magazine body comprises a latch member and the magazine well comprises a mating latch member.

17. The firearm of claim 8 wherein the magazine body must be refilled manually after firing a maximum of 11 shots.

18. The firearm of claim 8 wherein the magazine well is incompatible with detachable magazines.

* * * * *